US007421826B2

(12) United States Patent
Collins et al.

(10) Patent No.: US 7,421,826 B2
(45) Date of Patent: Sep. 9, 2008

(54) AIR CIRCULATION BOARD FOR CAVITY WALL CONSTRUCTION

(75) Inventors: P. Michael Collins, Cincinnati, OH (US); Steven E. Schaefer, Cincinnati, OH (US)

(73) Assignee: PACC Systems I.P., LLC, Cincinnati, OH (US)

( * ) Notice: Subject to any disclaimer, the term of this patent is extended or adjusted under 35 U.S.C. 154(b) by 68 days.

(21) Appl. No.: 10/417,761

(22) Filed: Apr. 17, 2003

(65) Prior Publication Data

US 2004/0003558 A1 Jan. 8, 2004

Related U.S. Application Data

(60) Provisional application No. 60/373,719, filed on Apr. 18, 2002.

(51) Int. Cl.
*E04B 1/70* (2006.01)

(52) U.S. Cl. ..... 52/302.1; 52/209; 52/378; 52/379; 52/513; 52/408; 52/410; 52/169.5; 52/302.3

(58) Field of Classification Search ..... 52/302.1, 52/302.3, 714, 741.3, 748.11, 565, 379, 378, 52/713, 209, 513, 408, 410, 169.5, 301.2, 52/301.3

See application file for complete search history.

(56) References Cited

U.S. PATENT DOCUMENTS 4,000,595 A 1/1977 Fortescue
4,446,661 A * 5/1984 Jonsson et al. ..... 52/95
4,852,320 A * 8/1989 Ballantyne ..... 52/302.3
4,916,875 A 4/1990 Kashiwagi
4,955,172 A 9/1990 Pierson
5,230,189 A 7/1993 Sourlis
5,343,661 A 9/1994 Sourlis
5,347,781 A * 9/1994 Hanlon ..... 52/379
5,598,673 A * 2/1997 Atkins ..... 52/302.1
5,860,259 A * 1/1999 Laska ..... 52/302.3
5,937,594 A 8/1999 Sourlis (Continued)

OTHER PUBLICATIONS

Mortar Net USA, Ltd. Website, www.mortarnet.com, Apr. 2, 2002.
PCT/US03/11926, *Search Report*, Dec. 12, 2003.

*Primary Examiner*—Jeanette E. Chapman
*Assistant Examiner*—Daniel Kenny
(74) *Attorney, Agent, or Firm*—Wood, Herron & Evans, LLP

(57) ABSTRACT

A corrugated board is secured to the inner wall of a cavity wall construction to establish a defined spacing between the inner and outer walls and prevent excess mortar from bridging to the inner wall. The corrugated board has a series of spaced channels, furrows or grooves into which an anchor projects into the studs of the inner wall to secure the outer wall. The corrugated board is installed prior to the construction of the outer wall and establishes a minimum spacing or gap between the walls based upon the thickness of the board. The outer wall is constructed immediately adjacent to the outer face of the corrugated board. The grooves or channels of the corrugated board create a chamber for vapor and air circulation. The board eliminates bridging by the mortar and provides an air conduit to exhaust even the minimal amounts of vapor that will occur in the cavity.

16 Claims, 3 Drawing Sheets

U.S. PATENT DOCUMENTS 6,023,892 A 2/2000 Sourlis
RE36,676 E 5/2000 Sourlis
6,256,955 B1 * 7/2001 Lolley et al. ..... 52/302.3
6,355,333 B1 * 3/2002 Waggoner et al. ..... 428/174
6,410,118 B1 * 6/2002 Reicherts et al. ..... 428/141
6,594,965 B2 * 7/2003 Coulton ..... 52/302.1
6,684,579 B2 * 2/2004 Brunson et al. ..... 52/169.5
2002/0124507 A1 * 9/2002 Atkins ..... 52/408

* cited by examiner

AIR CIRCULATION BOARD FOR CAVITY WALL CONSTRUCTION

This claims the benefit of U.S. Provisional Patent Application Ser. No. 60/373,719 filed Apr. 18, 2002 and hereby incorporated by reference in its entirety.

BACKGROUND OF THE INVENTION

This invention relates to brick veneer/cavity wall construction and, more particularly, to a device used in association with a brick veneer/cavity wall system for insuring air circulation which inhibits mold growth.

Brick veneer/cavity walls are typically used in construction offering a brick facade or veneer to the structure. Brick veneer/cavity walls are made with inner and outer walls. The inner wall is typically constructed from wood or steel studs with an interior surface of drywall or the like. The outer face of the inner wall typically includes a layer of sheathing such as plywood, particle board or the like, that is nailed to a wood framed wall. Commonly, a vapor barrier covers the sheathing material to limit moisture from progressing through the inner wall. The outer wall is generally constructed of masonry materials that are held together by mortar.

Common practice in many municipal building codes requires a space of at least one inch forming a cavity between the inner and outer walls. The reason for this cavity is to provide a space for water to drain and air to circulate, thereby keeping the cavity dry. When the cavity is dry and air can circulate, the conditions for mold growth are minimized. Commonly, anchors span the spacing and are embed into the mortar securing the outer brick wall to the inner wall. Flashing of PVC, asphalt impregnated membrane or other materials are included on the lower portion of the inner wall and across the bottom of the cavity covering a portion of a foundation to underlay the outer wall.

Frequently during the construction of a building with a brick veneer/cavity wall, the required separation between the inner and outer walls is not provided either through inattention to detail, sloppy practices or the like. Even with an appropriate separation, often when the masonry wall is being constructed, the mortar and other debris can and does escape from the back face of the outer wall to contact the vapor barrier on the inner wall. Excess mortar that spans the cavity between the two walls is referred to as "bridging".

One potentially catastrophic result of excess mortar bridging between the inner and outer walls is that the vapor barrier on the inner wall may be torn or damaged during construction thereby allowing moisture that travels along the "bridge" to become trapped between the remaining vapor barrier and the sheathing of the inner wall. Over time, such moisture conditions will generate mold growth which, if left unchecked would: attack the biodegradable structure and/or sheathing material causing them to fail, create a health hazard to occupants of the structure and/or present an expensive repair.

Mortar bridging from the outer masonry veneer to the attached structure is highly undesirable. Bridging provides a path for moisture, either condensed or liquid, to travel from the outer wall masonry work into the structure. Even if the vapor barrier is not breached, it may become saturated with moisture thereby providing a fertile environment for mold growth.

SUMMARY OF THE INVENTION

The above described and other shortcomings in the prior art have been addressed by the present invention which in one embodiment is a corrugated panel or board that is secured to the inner wall to establish a defined spacing between the inner and outer walls and prevent excess mortar from bridging to the inner wall. The corrugated board has a series of spaced channels, furrows or grooves into which an anchor projects into the studs of the inner wall to secure the outer brick wall. The corrugated board is installed prior to the construction of the outer brick wall and establishes a minimum spacing or gap between the walls based upon the thickness of the board. The outer brick wall will be constructed immediately adjacent to the outer face of the corrugated board.

The grooves or channels of the corrugated board create a chamber for vapor and air circulation thereby minimizing the conditions that promote mold growth in the cavity between the two walls. The board eliminates bridging by the mortar and provides an air conduit to exhaust even the minimal amounts of vapor that will occur in the cavity. The upper ends of the channels on the corrugated board are vented into the soffit or other areas at the upper ends of the walls. A self-sealing tape is applied to the interface between the inner wall and the anchor channels so that when the anchors penetrate the corrugated board, the self-sealing tape seals around the anchor to maintain the moisture barrier and minimize the chance of leaking at this location. Preferably, the bottom edge of the board is spaced about three inches or more from the foundation to allow for inlet and outlet venting of air. The corrugated board is preferably extruded plastic, metal, or other non-biodegradable material with self-sealing tape as an integral part by manufacture.

As a result, the present invention provides a durable and reliable solution to the above-described problems in the prior art and one which can be easily and efficiently installed with known cavity wall construction techniques.

BRIEF DESCRIPTION OF THE DRAWINGS

The objectives and features of the invention will become more readily apparent from the following detailed description taken in conjunction with the accompanying drawings in which.

DETAILED DESCRIPTION OF THE INVENTION

Figure 1:
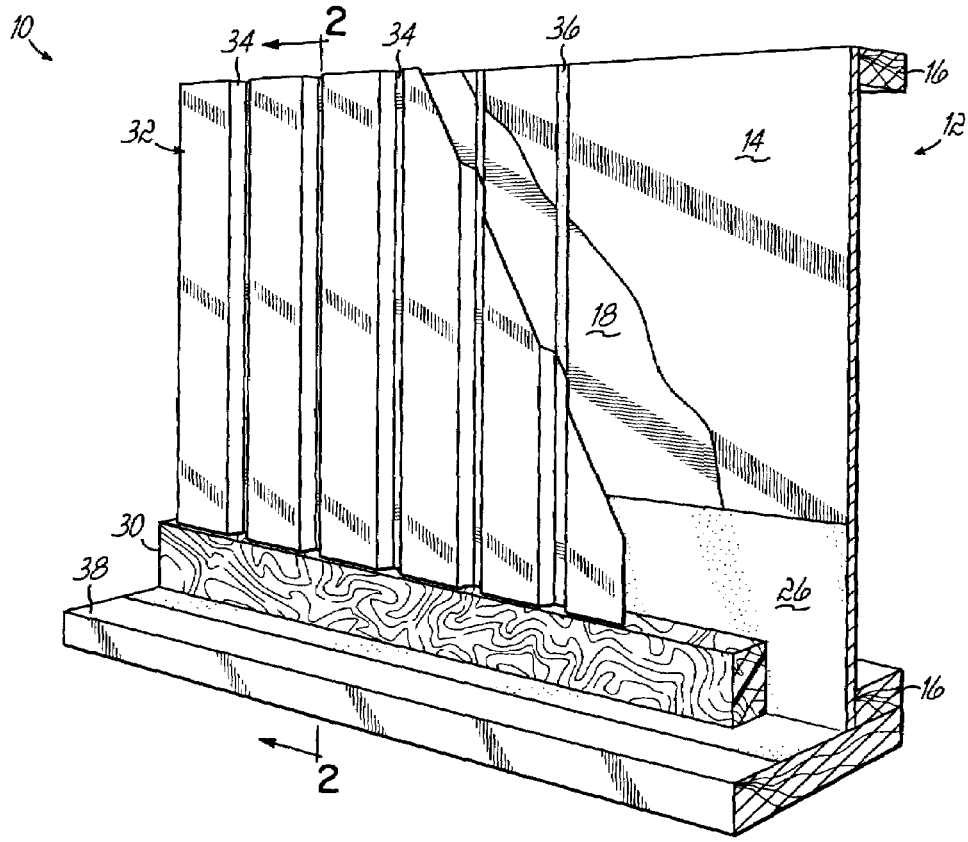
FIG. 1 is a perspective view of the inner wall and associated components of a cavity wall construction with a corrugated board according to the presently preferred embodiment of this invention shown partially broken away.
Figure 3:
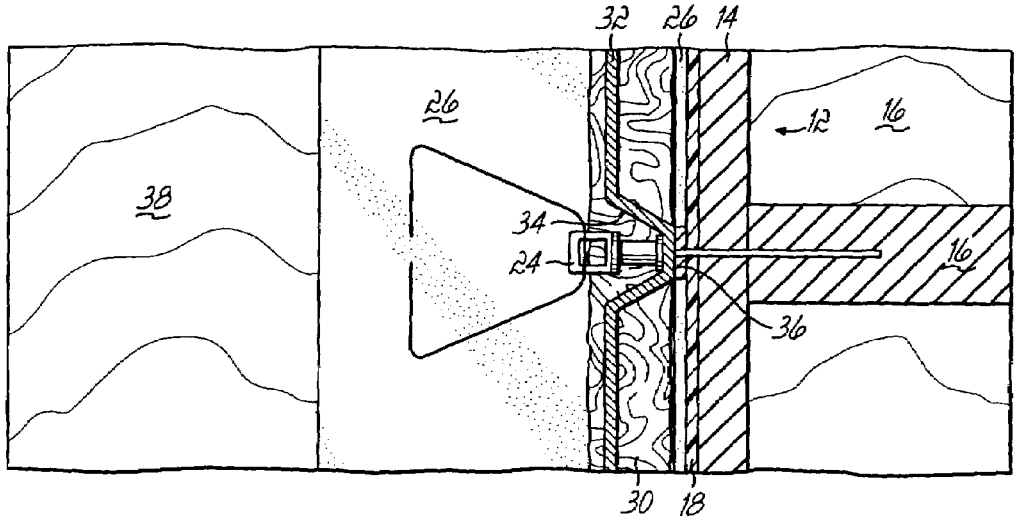
FIG. 3 is a cross-sectional view taken along line 3-3 of FIG. 2 looking downward on the assembly of FIG. 2.
Figure 2:
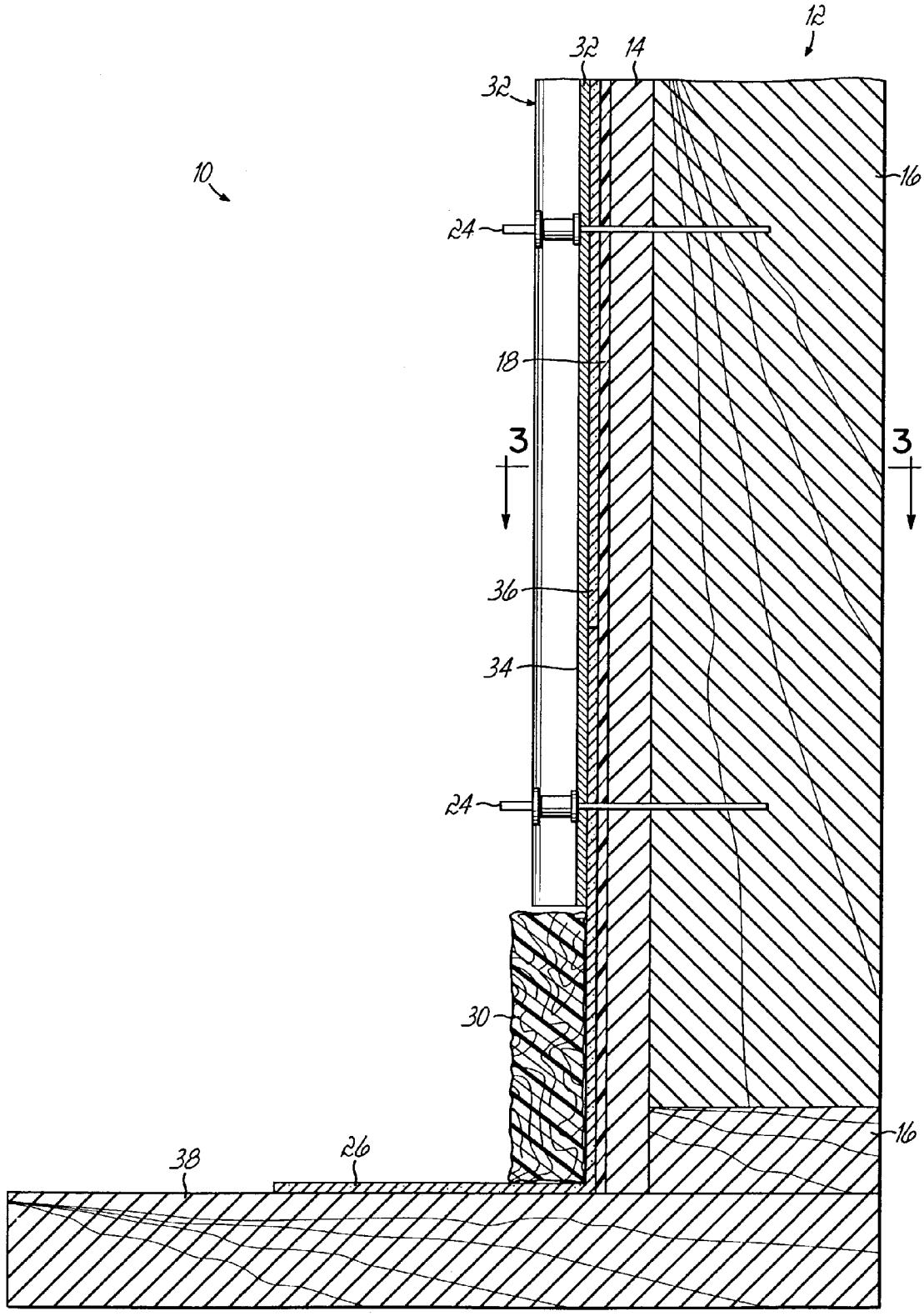
FIG. 2 is a cross-sectional view taken along line 2-2 of FIG. 1.
Figure 2A:
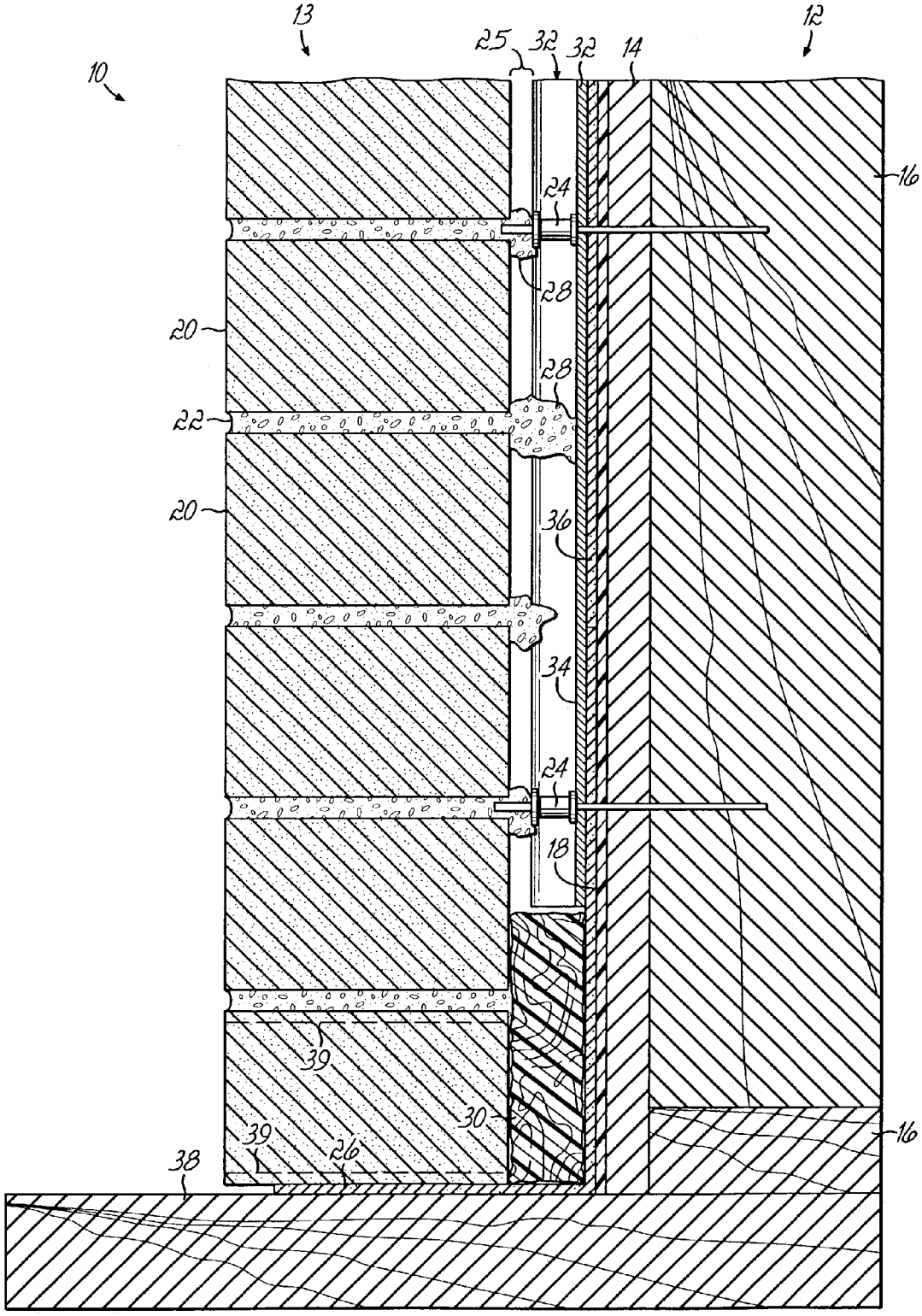
FIG. 2A is a view similar to FIG. 2 with an outer brick wall added thereto.

Referring to the drawings, a presently preferred embodiment of this invention is shown in a cavity wall 10 construction environment. As shown in FIGS. 1-3, brick veneer/cavity walls 10 are made with inner and outer walls 12, 13. The inner wall 12 is typically constructed from wood or steel studs 16 with an interior surface of drywall (not shown) or the like. The outer face of the inner wall 12 typically includes a layer of sheathing 14 such as plywood, particle board or the like, that is nailed to the wood framed wall 16. Commonly, a vapor barrier 18 covers the sheathing material 14 to limit moisture from progressing through the inner wall 12. The outer wall 13 (FIGS. 2A-3) is generally constructed of masonry materials 20, such as bricks, stone or the like, that are held together by mortar 22. Common practice in many municipal building codes requires a space of at least one inch forming a cavity 25 between the inner and outer walls 12, 13. The reason for this cavity 25 is to provide a space for water to drain and air to circulate, thereby keeping the cavity 25 dry. When the cavity 25 is dry and air can circulate, the conditions for mold growth are minimized. Anchors 24 span the cavity 25 and are embedded into the mortar 22 securing the outer wall 13 to the inner wall 12. Flashing 26 of PVC, asphalt impregnated membrane or other materials is included on the lower portion of the inner wall 12 and across the bottom of the cavity 25 covering a portion of a foundation 38 to underlay the outer wall 13. At that location in the masonry wall, the head joints are periodically left open to form a weep area 39 that allows for moisture drainage and an air inlet.

Frequently during the construction of a building with a brick veneer/cavity wall 10, the mortar 22 and other debris can and does escape from the back face of the outer wall 13 to contact the vapor barrier 18 on the inner wall 12. Excess mortar that spans the cavity between the two walls is referred to as "bridging" 28.

One potentially catastrophic result of excess mortar bridging between the inner and outer walls is that the vapor barrier on the inner wall may be torn or damaged during construction thereby allowing moisture that travels along the "bridge" to become trapped between the remaining 18 vapor barrier and the sheathing of the inner wall. Over time, such moisture conditions will generate mold growth which, if left unchecked would: attack the biodegradable structure and/or sheathing material causing them to fail, create a health hazard to occupants of the structure and/or present an expensive repair.

According to this invention, a corrugated panel or board 32 is secured to the inner wall 12 to establish a defined spacing between the inner and outer walls 12, 13 and prevent excess mortar 28 from bridging to the inner wall 12. The corrugated board 32 has a series of spaced channels, furrows or grooves 34 into which the anchor 24 projects into the studs 16 of the inner wall 12 to secure the outer wall 13. The corrugated board 32 is installed prior to the construction of the outer wall 13 and establishes a minimum spacing or gap between the walls 12, 13 based upon the thickness of the board 32. The outer wall 13 will be constructed immediately adjacent to the outer face of the corrugated board 32.

The grooves or channels 34 of the corrugated board 32 create a chamber for vapor and air circulation thereby minimizing the conditions that promote mold growth in the cavity 25 between the two walls 12, 13. The board 32 eliminates bridging 28 by the mortar to the inner wall 12 and provides an air conduit to exhaust even the minimal amounts of vapor that will occur in the cavity 25. The upper ends of the channels 34 on the corrugated board 32 are vented into the soffit or other areas at the upper ends of the walls 12, 13. A self-sealing tape 36 is applied to the interface between the inner wall 12 and the anchor channels 34 so that when the anchors 24 penetrate the corrugated board 32, the self-sealing tape 36 seals around the anchor 24 to maintain the moisture barrier and minimize the chance of leaking at this location. Preferably, the bottom edge of the board 32 is spaced about three inches or more from the foundation 38 to allow for inlet and outlet venting of air. The corrugated board 32 is preferably extruded plastic, metal, or other non-biodegradable material with self-sealing tape as an integral part by manufacture.

Excess mortar 22 that falls in the cavity to the foundation 38 at the base of the two walls 12, 13 often plugs the weep area that could also result in another condition that is similar to bridging and provide another mold growth environment. A mortar collector 30 such as a net or similar device is commonly provided atop the foundation 38 at the base between the two walls 12, 13 to inhibit clogging the weep holes. One type of mortar netting is commercially available from Mortar Net USA, Ltd. (www.mortarnet.com). U.S. Pat. Nos. 5,937,594; 5,234,189; 6,023,892; Reissue Pat. No. 36,676 and U.S. Pat. No. 4,852,320, each of which are hereby incorporated by reference in its entirety, are directed to mortar collectors or devices to inhibit clogging of weep holes.

As a result of this invention, the corrugated board 32 provides a rigid surface to lay masonry veneer there against to eliminate mortar bridging. The corrugated board 32 also creates a chamber for vapor and air circulation thereby minimizing the conditions that promote mold growth in the cavity 25 between the back of the masonry veneer outer wall 13 and the attached inner wall 12 and associated interior structure of the building.

From the above disclosure of the general principles of the present invention and the preceding detailed description of at least one preferred embodiment, those skilled in the art will readily comprehend the various modifications to which this invention is susceptible. Therefore, we desire to be limited only by the scope of the following claims and equivalents thereof.

We claim:

1. A cavity wall construction comprising:

a foundation;

an inner wall extending upwardly from the foundation;

wherein the inner wall is comprised of a plurality of generally parallel and evenly spaced vertically extending studs;

an outer wall supported upon the foundation, having an inner face confronting an outer face of the inner wall and being generally parallel to and spaced from the inner wall to define a cavity therebetween;

wherein the outer wall is comprised of courses of masonry material held together with mortar between the adjacent courses;

a corrugated board positioned between the inner and outer walls and covering a substantial portion of the outer face of the inner wall to inhibit the mortar from contacting the inner wall;

a plurality of channels in the corrugated board permitting the escape of fluid trapped in the cavity;

a plurality of generally linear spines in the corrugated board, each spine being interposed between an adjacent pair of the channels and being in confronting contact with the outer face of the inner wall;

wherein selected spines of the corrugated board are aligned with one of the studs of the inner wall;

wherein the inner wall further comprises:

a sheathing board attached to the plurality of studs and forming the outer face of the inner wall; and a plurality of anchors each coupled to the outer wall located in one of the selected spines and joining the corrugated board to the associated stud.

2. The cavity wall construction of claim 1 further comprising:

a vapor barrier substantially covering the outer face of the inner wall to inhibit moisture from penetrating into the inner wall.

3. The cavity wall construction of claim 1 further comprising:

a self-sealing tape joining each of the selected spines to the inner wall.

4. A cavity wall construction comprising:

a foundation;

an inner wall extending upwardly from the foundation;

wherein the inner wall is comprised of a plurality of generally parallel and evenly spaced vertically extending studs;

an outer wall supported upon the foundation, having an inner face confronting an outer face of the inner wall and being generally parallel to and spaced from the inner wall to define a cavity therebetween;

wherein the outer wall is comprised of courses of masonry material held together with mortar between the adjacent courses;

a corrugated board of a material substantially impervious to the transmission of water therethrough and positioned between the inner and outer walls and covering a substantial portion of the outer face of the inner wall to inhibit the mortar from contacting the inner wall;

a plurality of channels in the corrugated board permitting the escape of fluid trapped in the cavity;

a plurality of generally linear and vertically oriented spines in the corrugated board, each spine being interposed between an adjacent pair of the channels and being in confronting contact with the outer face of the inner wall and spaced from the outer wall;

wherein selected spines of the corrugated board are aligned with one of the studs of the inner wall;

wherein the corrugated board is generally spaced from the courses of masonry material.

5. The cavity wall construction of claim 4 further comprising:

a self-sealing tape joining the selected spines to the inner wall; and a plurality of anchors each projecting through the selected spines in the corrugated board and into the associated stud of the inner wall and being coupled to the outer wall;

wherein the self-sealing tape provides a seal around each anchor to thereby inhibit transfer of moisture to the inner wall.

6. The cavity wall construction of claim 4 wherein the corrugated board does not support the courses of masonry material.

7. A cavity wall construction comprising:

a foundation;

an inner wall extending upwardly from the foundation;

wherein the inner wall is comprised of a plurality of generally parallel and evenly spaced vertically extending studs;

an outer wall supported upon the foundation, having an inner face confronting an outer face of the inner wall and being generally parallel to and spaced from the inner wall to define a cavity therebetween;

wherein the outer wall is comprised of courses of masonry material held together with mortar between the adjacent courses;

a corrugated board positioned between the inner and outer walls and covering a substantial portion of the outer face of the inner wall to inhibit the mortar from contacting the inner wall, wherein a bottom edge of the corrugated board is spaced from the foundation and, wherein the corrugated board is a material which is substantially impervious to the transmission of water therethrough;

a plurality of channels in the corrugated board permitting the escape of fluid trapped in the cavity; and a plurality of generally linear spines in the corrugated board, each spine being interposed between an adjacent pair of the channels and being in confronting contact with the outer face of the inner wall;

wherein selected spines of the corrugated board are aligned with one of the studs of the inner wall.

8. The cavity wall construction of claim 7 further comprising:

a flashing covering a lowermost portion of the outer face of the inner wall and extending along the foundation to span the cavity and underlay at least a portion of the outer wall.

9. The cavity wall construction of claim 7 further comprising:

a mortar collector positioned atop the foundation and in the cavity proximate a base of the inner and outer walls.

10. The cavity wall construction of claim 7 further comprising:

a weep area positioned in the masonry material proximate the foundation.

11. The cavity wall construction of claim 7 further comprising:

a plurality of anchors projecting through the selected spines in the corrugated board and into the associated stud of the inner wall and being coupled to the outer wall.

12. The cavity wall construction of claim 11 wherein each of the anchors is engaged with the outer wall.

13. The cavity wall construction of claim 12 wherein a portion of each of the anchors is embedded in the outer wall.

14. The cavity wall construction of claim 7 wherein the plurality of channels and the plurality of spines extended substantially uninterrupted the full height of the corrugated board and produce a uniform and repeating pattern of the corrugated board.

15. The cavity wall construction of claim 7 wherein the plurality of channels and the plurality of spines extended substantially uninterrupted the full height of the corrugated board and produce a uniform and repeating pattern of the corrugated board.

16. A cavity wall construction comprising:

a foundation;

an inner wall extending upwardly from the foundation;

wherein the inner wall is comprised of a plurality of generally parallel and evenly spaced vertically extending studs;

an outer wall supported upon the foundation, having an inner face confronting an outer face of the inner wall and being generally parallel to and spaced from the inner wall to define a cavity therebetween;

wherein the outer wall is comprised of courses of masonry material held together with mortar between the adjacent courses;

a corrugated board positioned between the inner and outer walls and covering a substantial portion of the outer face of the inner wall to inhibit the mortar from contacting the inner wall;

a plurality of channels in the corrugated board permitting the escape of fluid trapped in the cavity; and a plurality of generally linear spines in the corrugated board, each spine being interposed between an adjacent pair of the channels and being in confronting contact with the outer face of the inner wall;

wherein selected spines of the corrugated board are aligned with one of the studs of the inner wall;

wherein the plurality of channels and the plurality of spines extended substantially uninterrupted the full height of the corrugated board and produce a uniform and repeating pattern of the corrugated board;

wherein the plurality of channels are spaced from both the inner and outer walls and only the spines are in contact with the inner wall.

* * * * *